United States Patent [19]

Asao

[11] 4,429,878

[45] Feb. 7, 1984

[54] FOLDABLE PUZZLE CARDS

[76] Inventor: Noriji Asao, 607, Fuchu-cho, Fuchu-shi, Hiroshima-ken, Japan

[21] Appl. No.: 311,616

[22] Filed: Oct. 15, 1981

[51] Int. Cl.[3] ..... A63F 9/08

[52] U.S. Cl. ..... 273/155; 46/1 L

[58] Field of Search ..... 273/155; 46/1 L

[56] References Cited

U.S. PATENT DOCUMENTS

| | | | |
|---|---|---|---|
| 239,879 | 4/1881 | Stranders | 273/155 X |
| 847,545 | 3/1907 | Braine | 273/155 X |
| 2,092,583 | 9/1937 | Michael | 273/155 |
| 2,327,875 | 8/1943 | Edborg | 273/155 |
| 3,962,816 | 6/1976 | Sarid | 273/155 X |

*Primary Examiner*—Anton O. Oechsle

[57] ABSTRACT

Both ends of four strips each including four equal foldable card boards are superposed one upon the other to form a rectangular frame. End card boards of two adjacent strips are foldably interconnected and front and rear surfaces of each card board are provided with predetermined patterns. By suitably folding respective strips in one or opposite direction a desired pattern can be formed.

5 Claims, 22 Drawing Figures

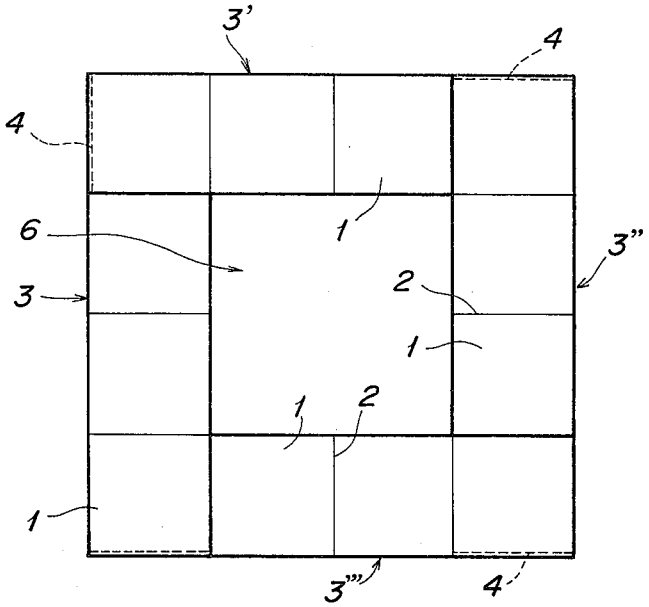
FIG. 7
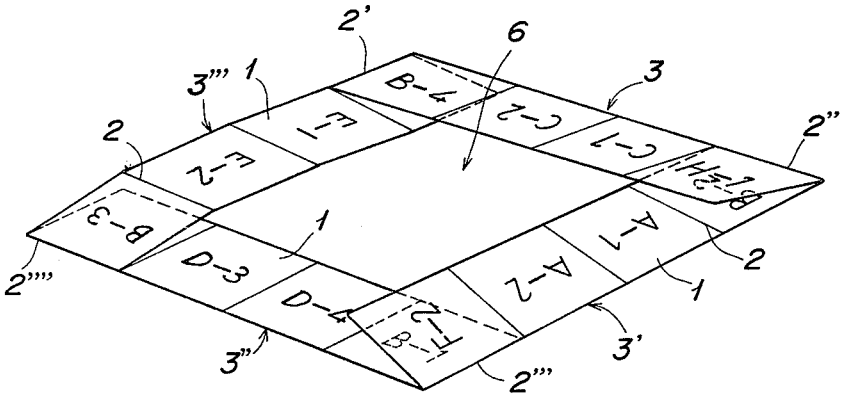

FIG.8
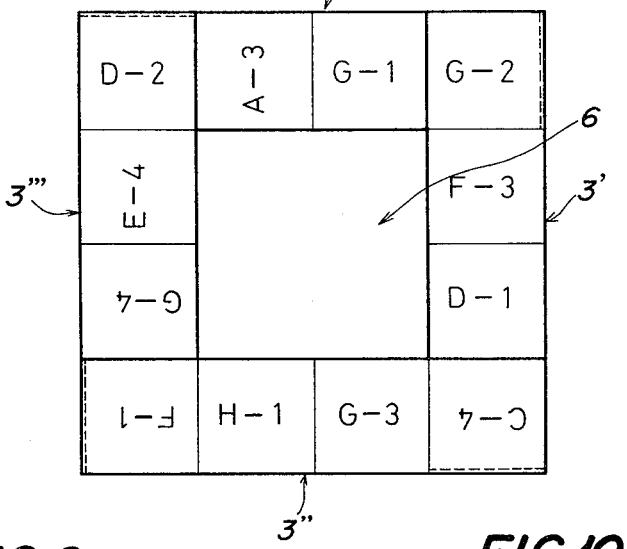
FIG.9A
FIG.10A
FIG.9B
FIG.10B
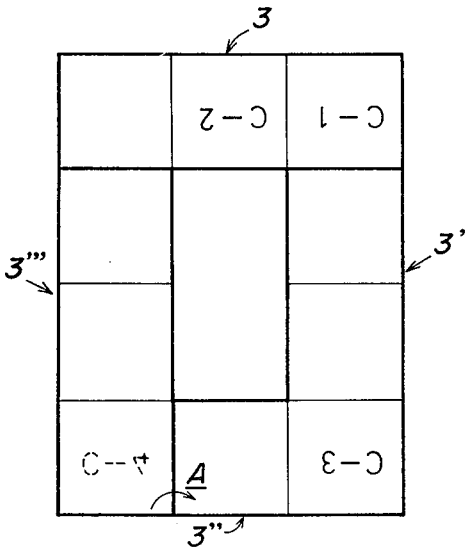
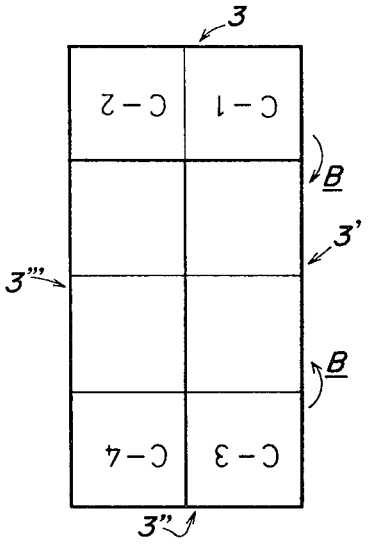
FIG.9C
FIG.10C

FOLDABLE PUZZLE CARDS

BACKGROUND OF THE INVENTION

This invention relates to a foldable puzzle card, and more particularly a foldable puzzle card of the type comprising a plurality of foldably connected puzzle card boards with their front and rear surfaces provided with patterns, and wherein certain number of the cards are folded in a predetermining manner, to form a desired pattern.

Some of the prior art puzzle cards comprise only a small number of cards or shaped in a hollow rectangular frame. In another type a plurality of unit cards are linearly combined into a set, and the units are divided into a front unit and a rear unit. Since desired pattern or configuration is obtained by combining front units, or rear units front and rear units so that in the finally folded state, the configuration is too simple or patterns of the combined units overlap each other, so that such card lacks interest and some of the units are not used.

SUMMARY OF THE INVENTION

It is an object of this invention to provide an improved foldable puzzle card capable of forming a variety of interesting patterns while avoiding overlapped combined patterns and without leaving some of the card units idle.

According to this invention there is provided a foldable puzzle card comprising four elongated rectangular strips, each including four equal card boards which are foldably connected with each other, the four strips being disposed to form a rectangular frame, and means for foldably connecting end card board on both sides one strip with end card boards on both sides of the other two strips extending perpendicularly to the one strip so as to cause interconnected end card boards of the one strip and of the other strips to overlap each other, front and rear surfaces of each card board being provided with predetermined patterns whereby by suitably folding the strips a desired pattern can be formed with patterns formed on the card boards.

BRIEF DESCRIPTION OF THE DRAWINGS

Further objects and advantages of the invention can be more fully understood from the following detailed description taken in conjunction with the accompanying drawings in which:

FIGS. 4A' and 4B' are side views showing the states of folding at steps shown in FIGS. 4A and 4B respectively, FIGS. 5 and 6 are plan views showing the second and third embodiments of this invention;

FIG. 7 is a perspective view showing a different method of interconnection of four foldable strips;

FIG. 8 is rear plan view of the foldable puzzle card shown in FIG. 7; and FIGS. 9A, 9B, 9C, 10A, 10B and 10C show successive steps of folding respective strips to obtain an arrangement of a pattern shown in FIG. 11.

DESCRIPTION OF THE PREFERRED EMBODIMENTS

Figure 1:
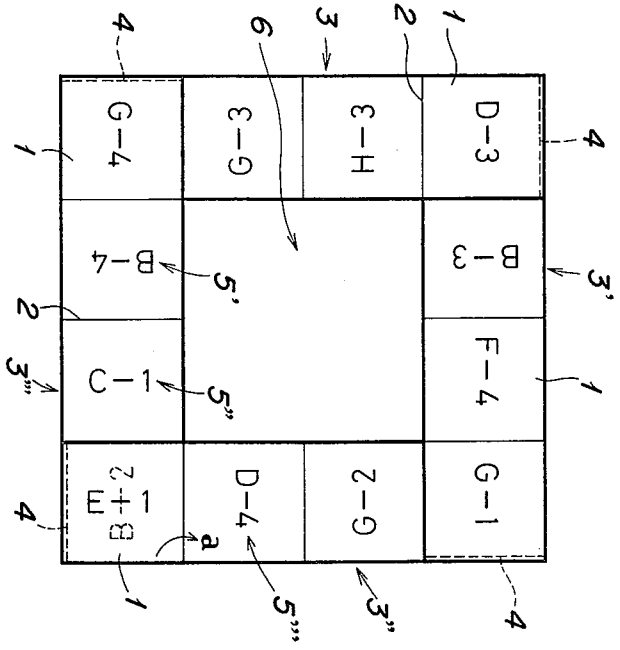
FIG. 1 is a front plan view showing a first embodiment of the foldable puzzle card according to this invention.
Figure 2:
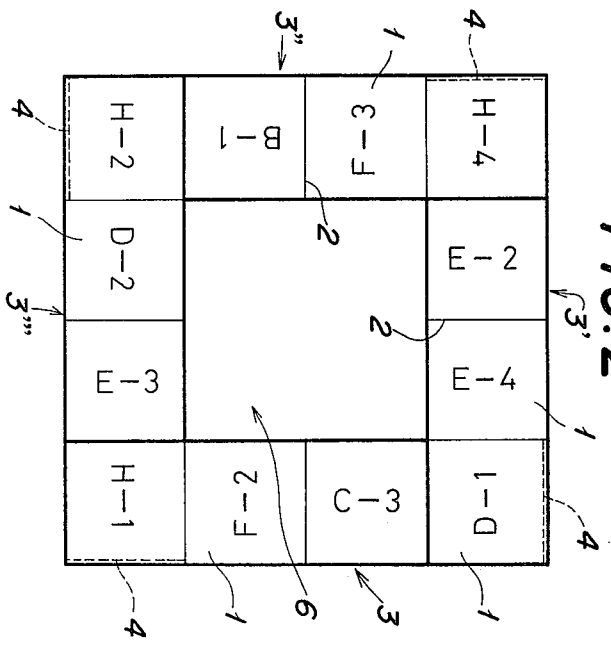
FIG. 2 is a rear plan view of the embodiment shown in FIG. 1.
Figure 3:
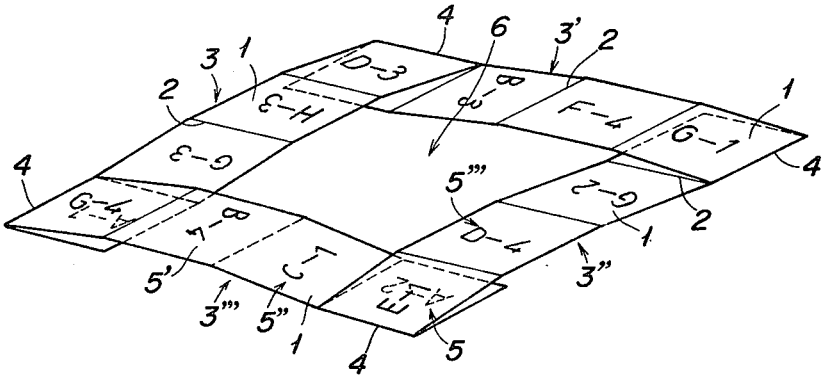
FIG. 3 is perspective view of the foldable puzzle card shown in FIGS. 1 and 2.

In the first embodiment shown in FIGS. 1, 2 and 3, a total of 16 rectangular, in this example, square card boards 1 having the same size are foldably connected together, the front and rear surfaces serving as display surfaces or portions, that is formed with printed patterns, for example. According to this invention, four contiguous card boards 1 are interconnected into four sets 3, 3', 3'' and 3''' of a strip form. Respective card boards are foldable at their joints 2. The sets or strips are interconnected into a square frame shape. In this state, the card boards on the opposite ends of a specific strip overlap the end card boards of adjacent strips extending at right angles with respect to the specific strips. Two strips extending perpendicularly are interconnected to be foldable at a joint 4. As best shown in FIG. 3 as above described, the front and rear display surfaces of each card board are provided with display patterns, and a total of 8 sets of display members 5, 5', 5'', 5''' . . . , each comprising four display patterns, can be formed.

Figure 4A:
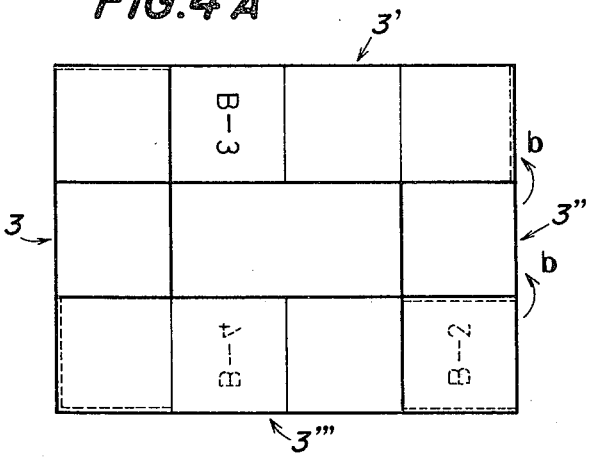
FIGS. 4A–4D are plan views showing the order of combining strip shaped card units.
Figure 4:
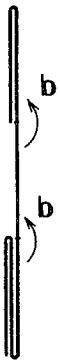

More particularly, four foldable strips 3, 3', 3'' and 3''' are interconnected in the counterclockwise direction as viewed in FIG. 4 at the joints 4 with the end card boards of each strip overlapped upon the end card boards of adjacent strips.

At each corner of the square shape frame member, since two end card boards of adjacent strips overlap one upon the other, a square opening 6 is formed at the center of the square frame which makes easy the folding of respective card boards 1.

Various desired patterns of any color may be provided for or printed on the front and rear surfaces of respective card boards. For example, in a combination of 8 sets each including 4 contiguous card boards, patterns are applied on the display surfaces as shown by alphabets and in directions shown in FIGS. 1 to 3.

Each foldable joint 2 may be formed by applying pliable tapes to the card boards.

Figure 4B:
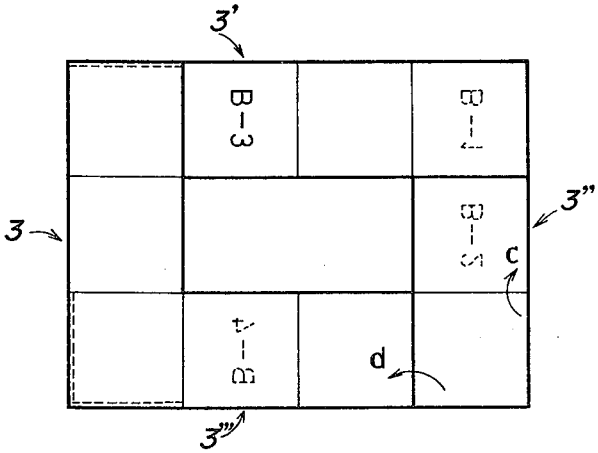
Figure 4:
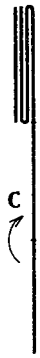
Figure 4C:
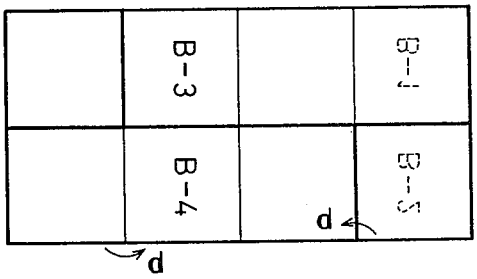
Figure 4D:
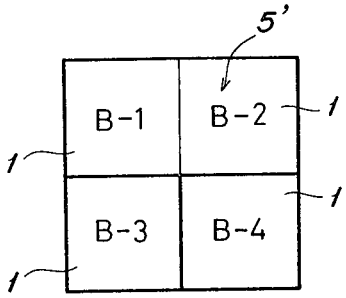

When it is desired to combine display portions B-1, B-2, B-3 and B-4 of the display members 5, 5', 5'' . . . as shown in FIG. 4D, the lower strip 3''' is folded in the direction of an arrow a shown in FIG. 1 onto adjacent strips 3 and 3''. Then, as shown in FIGS. 4A and 4A' the upper strip 3' is folded in the direction of arrow b onto adjacent strips 3 and 3''' along joints 2. Then, display portions B-1 and B-2 which overlap each other in the state shown in FIG. 4A would be juxtaposed on the rear side as shown in FIGS. 4A and 4B. Then, as shown in FIGS. 4B and 4B', the strip 3''' is folded in a direction of arrow c onto left and right strips 3 and 3'' along joint 2. Then the display portion B-4 which was on the rear side in the state shown in FIGS. 4A and 4B will be brought to the front side as shown in FIG. 4C to adjoin the display portion B-3.

Then, as shown in FIG. 4C, the left and right strips 3 and 3'' with their end card boards 1 are folded in the direction of d, more particularly, the left strip 3 is folded toward the rear side, while the right strip is bent toward the front side. Accordingly, the strip 3 is folded onto the rear side of the card boards 1 designated by B-3 and B-4 in FIG. 4C, while the right strip 3″ is folded on the strips 3′ and 3″ so as to bring the display portions B-1 and B-2 on the front side and the other display portions B-3 and B-4 are displaced toward right.

Under this state, since the display portions B-1, B-2, B-3 and B-4 are all on the front side, when the assembly is rotated 90° in the counterclockwise direction, a state shown in FIG. 4D can be obtained. When combined in this manner, patterns on display portions B-1, B-2, B-3 and B-4 cooperate to form a desired pattern.

In the same manner, the other seven sets can be combined to form different patterns. Of course, the positions of the patterns on respective display portions of respective strips are preset so that finally obtained patterns would be different for different combinations of the strips.

Figure 5:
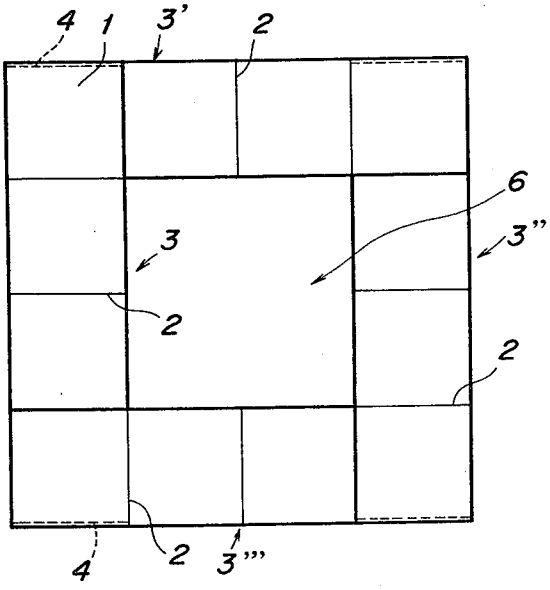

FIG. 5 shows a second embodiment of this invention in which four foldable strips 3, 3′, 3″ and 3‴ are interconnected into a square frame shape with their end card boards overlapped one upon the other in the same manner as in the first embodiment. In the second embodiment, however, both end card boards of the vertical strips 3 and 3″ are foldably connected to the end card boards of the horizontal strips 3′ and 3‴.

FIG. 6 shows a third embodiment of this invention wherein four foldable strips 3, 3′, 3″ and 3‴ interconnected in the same manner as in the first and second embodiments are superposed one upon the other in the order opposite to that of the first embodiment. In this embodiment, the end card boards of the vertical strip 3‴ are foldably connected to the end card boards of the horizontal foldably strips 3′ and 3‴, the upper end card block of the left vertical folderable strip 3 is foldably connected to the left end card board of the upper foldable strip 3′ and the right end card board of the strip 3′ is foldably connected to the upper end card board of the vertical foldably strip 3″. With these modified embodiments too, the same object and function as those of the first embodiment.

As above described, according to this invention, a total of 16 card boards are connected to form four straight foldable strips and the both surfaces of each card board are formed with display surfaces with patterns, thus providing a total of 32 display surfaces and the four foldable strips are foldably interconnected into a rectangular frame shape. Accordingly, by variously folding the strips various types of final patterns can be obtained. Since the final pattern can not readily be anticipated and requires due consideration as to which one or ones of the foldable strips should be folded in one or opposite direction, it is possible to provide interesting foldable puzzle card. Moreover as the desired pattern can be obtained by folding the strips instead of changing their positions in the same plane as in the prior art, all display portions can be used efficiently.

In another embodiment shown in FIGS. 7 and 8, the construction of the foldable strips 3, 3′, 3″ and 3‴ is the same as that shown in the previous embodiments. However, their order of overlapping is slightly different from that shown in FIG. 3. More particularly, the left card board of the upper strip 3 is foldably connected to the left or transverse side 2′ of the upper card board of the left strip 3″, and the lower card board thereof overlies and foldably connected to the lower side 2‴ of the left end card board of the lower strip 3″. The lower card board of the right strip 3′ overlies the right end card board of the lower foldable strip 3″ and foldably connected to the right side 2‴ thereof, while the upper end card board of the right strip 3′ underlies the right card board of the upper strip 3 at the upper side 2″ thereof. Accordingly when the foldable puzzle card shown in FIG. 7 is inverted, its plan view will be shown by FIG. 8.

Figure 11:
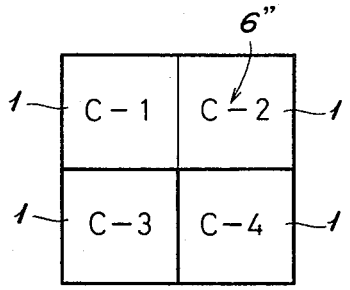

To obtain a pattern shown in FIG. 11, the right strip 3′ is folded toward the rear side, and the strips 3″ is folded such that end card boards of the strip 3″ at a corner between the lower strip 3″ and the right strip 3′ is reversed thereby bringing a display portion C-3 not seen in FIG. 7 to the front side as shown in FIG. 9. Then, the left strip 3‴ is folded as shown by arrow A to bring the display portion C-4 on the upper side as shown in FIG. 10. However, as shown in FIG. 10 display portions C-1, C-2, C-3 and C-4 are positioned upside down, the upper strip 3 and the lower strip 3″ are folded back on the strips 3″ and 3′ in the direction of B and the folded strips are inverted to obtain a final pattern as shown in FIG. 11

Although in the foregoing examples an example of using only one set among 8 sets of display portions was described, the remaining 7 sets can be used for different combinations provided that the positions of the display portions of respective sets are preset so as to obtain different final patterns.

Figure 12:
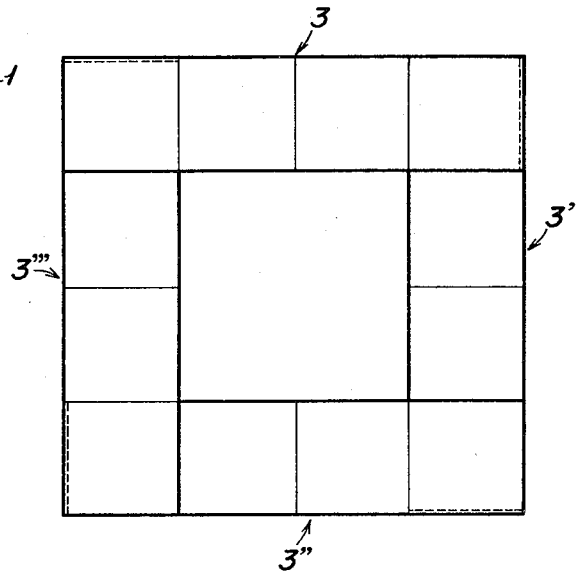
FIGS. 12 and 13 are plan views showing the other different method of the interconnection of four foldable strips.
Figure 13:
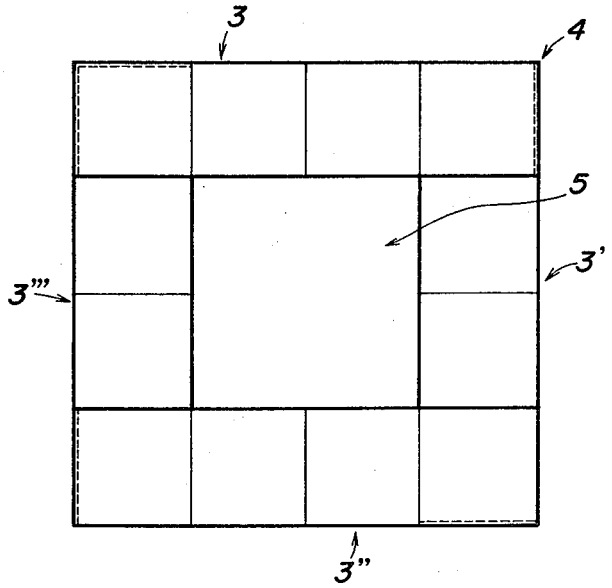

FIGS. 12 and 13 show the different orders of overlapping the foldable strips 3, 3′, 3″ and 3‴.

In the embodiment shown in FIG. 12, the right end card board of the lower strip 3″ overlies the lower end card board of the right strip 3′, while the remaining construction is exactly same as shown in FIG. 8.

In the embodiment shown in FIG. 13, the left end card board of the lower strip 3″ overlies the lower end card board of the left strip 3‴ and the left end card board of the upper strip 3 is connected to the upper end card of the left strip 3‴ at both the upper edge and the left side edge, while the remaining construction is exactly same as shown in FIG. 12.

It should be understood that the manner of overlapping end card boards of respective strips is not limited to those illustrated in the accompanying drawings and that many other methods of overlapping may be used.

Although some specific examples of overlapping and interconnecting respective strips have been illustrated, it should be understood that there are many other methods of overlapping and interconnecting the strips.

What is claimed is:

1. A foldable puzzle card comprising four elongated rectangular strips, each including four equal card boards which are foldably connected with each other, said four strips being disposed to form a rectangular frame, and means for foldably interconnecting end card boards on both sides of one strip with end card boards on both sides of the other two strips extending perpendicularly to said one strip so as to cause interconnected end card boards of said one strip and of the other strips to overlap each other, front and rear surfaces of each card board being provided with predetermined patterns whereby by suitably folding said strips a desired pattern can be formed with patterns formed on said card boards.

2. The foldable puzzle card according to claim 1 wherein end card boards of respective strips are superposed one upon the other to form a rectangular frame, and a lateral side of one end card board of one strip is foldably connected to a longitudinal side of the other strip.

3. The foldable puzzle card according to claim 1 wherein at each one of three corners of a rectangular frame, a lateral side of one end card board of one strip is foldably connected to a longitudinal side of one end card board of the other strip, while at the remaining one corner, a longitudinal side of the one end card board of said one strip is foldably connected to a lateral side of the one end card board of said other strip.

4. The foldable puzzle card according to claim 1 wherein end card boards of respective strips are superposed one upon the other to form a rectangular frame and wherein, at each one of corners on a diagonal; a lateral side of one end card board of one strip is foldably connected to a longitudinal side of one end card board of the other strip, while at each one of the corners on the other diagonal, a longitudinal side of one end card board of said one strip is foldably connected to a lateral side of one end card board of said other strip.

5. The foldable puzzle card according to claim 1 wherein end card boards of respective strips are superposed one upon the other to form a rectangular frame, and wherein at one corner of said rectangular frame, an order of super-position of two strips is reversed and a lateral side of one end card board of one strip is foldably connected to a longitudinal side of one end card board of the other strip, while at each one of the remaining corners a longitudinal side of one end card board of said one strip is foldably connected to a lateral side of one end card board of said other strip.

* * * * *